US005549781A

United States Patent [19]

Schotter

[11] Patent Number: 5,549,781

[45] Date of Patent: Aug. 27, 1996

[54] COIL WINDING APPARATUS INCORPORATING A FLEXIBLE WINDING FLANGE

[75] Inventor: Daniel K. Schotter, Tucson, Ariz.

[73] Assignee: Hughes Missile Systems Company, Los Angeles, Calif.

[21] Appl. No.: 488,005

[22] Filed: Jun. 7, 1995

[51] Int. Cl.[6] ..... B65H 54/00; F42B 15/04

[52] U.S. Cl. ..... 156/443; 156/169; 156/425; 156/429; 242/173

[58] Field of Search ..... 156/169, 173, 156/175, 180, 425, 428, 429, 422, 136, 443; 242/170, 172, 173, 174, 176, 18 R, 47, 548, 520, 521, 536

[56] References Cited

U.S. PATENT DOCUMENTS 4,484,974 11/1984 Rothman ..... 156/425

4,593,815 6/1986 Wright ..... 242/173

5,228,631 7/1993 Hu et al. ..... 242/173

*Primary Examiner*—Michael W. Ball

*Assistant Examiner*—Michael Tolin

*Attorney, Agent, or Firm*—Charles D. Brown; Randall M. Heald; Wanda K. Denson-Low

[57] ABSTRACT

An apparatus for winding a coil pack of a fiber such as an optical fiber winds the fiber as a radial coil, and then joins the coil axially to previously wound coils. Each radial coil is wound on a flexible flange that is deformable from a first tapered shape which facilitates the winding against the flange, to a second shape wherein the coil wound thereon conforms to the shape of the last coil affixed to the fiber pack. The flexible flange is preferably made of an elastomer, and its shape change is readily accomplished by an articulated series of nesting cylinders. The apparatus further includes a fiber winding head that winds the fiber onto the flexible flange, and an adhesive applicator head that applies adhesive between succeeding coils of fiber as they are joined to the coil pack.

19 Claims, 4 Drawing Sheets

COIL WINDING APPARATUS INCORPORATING A FLEXIBLE WINDING FLANGE

BACKGROUND OF THE INVENTION

This invention relates to the winding of coils to form a coil pack, and, more particularly, to the formation of the coil pack from a series of radially wound individual coils.

Several types of missiles are controlled through a fiber extending from the missile to its launch point. The fiber is initially wound into a pack within the missile or a canister at the launch point, and is rapidly dispensed after the missile is launched and flies toward its target. The "fiber" used in many such control systems is an electrically conducting wire such as a thin copper wire. More recently, the "fiber" has been an optical fiber that has a higher data transmission capability than does the metallic wire. The fiber is typically on the order of 0.010 inches in diameter for optical fibers and 0.005 inches in diameter for electrically conducting wires An important element of control system is the fiber dispenser, which must receive a long length of the fiber thereon for storage. The fiber dispenser must further facilitate the payout of the fiber in an orderly manner such that the fiber does not break or sustain significant damage during dispensing. Damage to the fiber leads to a loss of communication between the launch point and the missile, and either renders the missile useless or may lead to automatic self-destruction of the missile. The fiber dispenser must achieve a smooth, damage-free payout of lengths of fiber than may range from a few kilometers for hand-fired missiles to well over a hundred kilometers for some types of ground-to-ground or air-to-ground missiles. The missile velocity may be as low as tens of kilometers per hour for torpedoes to a thousand kilometers per hour for missiles that fly through the air.

In one approach to fiber storage and payout, the fiber is wound as a series of constant-radius turns along the length of a cylindrical mandrel to form a layer, with each succeeding layer resting on the previously wound layer. During payout, each layer is successively dispensed. In this technique, the capacity of the dispenser is enlarged by increasing the number of layers. In another approach, a coil pack is built up by winding an outwardly spiralling coil onto a flange, winding a second outwardly spiralling coil axially adjacent to the first coil, and so on. During payout, each coil is successively dispensed. The capacity of the dispenser is enlarged by increasing the axial length of the coil pack by adding more coils to the end of the coil pack. Each of these geometries has its advantages for specific applications. The present invention is concerned with the second approach, wherein the coil pack is fabricated as a series of outwardly spiralling coils that are joined to each other axially.

The winding of a single outwardly spiralling coil requires careful control of the winding apparatus, and the fabrication of a coil pack with a succession of such coils presents difficult challenges both in winding the individual coils and also in positioning the coils in an efficient array. The earliest coil pack fabrication apparatus operated to wind a first spiral coil. Then a second spiral coil was wound using a series of tapered rollers in a guided, but somewhat free-form, manner axially contacting the first spiral coil, and the process was repeated. This approach is slow and is potentially inaccurate, and has a relatively high likelihood of introducing winding defects into the coil pack that can lead to fiber damage during payout. Improvements have been made, but the winding of a coil pack remains a difficult and time consuming process.

Accordingly, there is a need for an improved approach to the fabrication of coil packs. The present invention fulfills this need, and further provides related advantages.

SUMMARY OF THE INVENTION

The present invention provides an apparatus and method for fabricating a coil pack of a series of spirally wound fiber coils that are axially joined to adjacent spirally wound fiber coils. The approach to coil pack fabrication is faster than prior techniques, an important advantage because it is necessary to wind up to several hundred kilometers of fiber into a coil pack in some cases. The potential for introduction of winding defects into the coil pack is minimized with the present approach.

In accordance with the invention, a coil pack winding apparatus comprises a central shaft having a first location and an oppositely disposed second location, a first flange overlying the central shaft at a location adjacent to the first location of the central shaft, and a coil support base. The coil support base comprises a flexible flange having an inner edge adjacent to the central shaft and an outer edge remote from the central shaft. The flexible flange, preferably made of an elastomeric material, has a shape that is variable between a first position wherein a first-position distance of the inner edge of the flexible flange from the first flange is less than a first-position distance of the outer edge of the flexible flange from the first flange, and a second position wherein a second-position distance of the inner edge of the flexible flange from the first flange is substantially the same as a second-position distance of the outer edge of the flexible flange from the first flange. The coil support base also includes means for flexing the flexible flange between the first position and the second position, such as a plurality of nestable cylinders positioned such that the flexible flange is between the first flange and the plurality of nestable cylinders and a cylinder drive. The apparatus further includes a fiber winding head including a fiber guide, and means for moving the fiber winding head circumferentially relative to the central shaft. Additionally, there can be, and preferably is, a controllable adhesive applicator.

With this apparatus or other operable apparatus, a coil pack is prepared by winding a coil of a fiber onto the flexible flange when the flexible flange has the first shape, and deforming the flexible flange and the coil of fiber wound thereon to the second shape. The coil of fiber is thereby wound in a convenient manner and thereafter positioned adjacent to the previously wound coil of fiber. The coil of fiber is joined to the previously wound coil of fiber, using an adhesive. The coil pack is thus incrementally elongated with the addition of successive spiral coils of fiber.

The present approach produces the coil pack in a systematic and reproducible series of repeating steps. It therefore lends itself to complete automation, with the various drives of the apparatus under the control of a central processing unit. The coil pack is fabricated rapidly and controllably.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
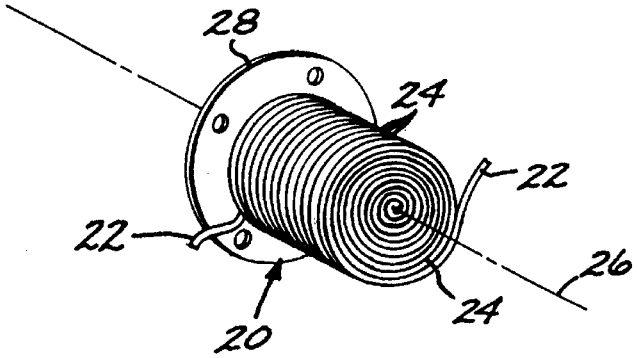
FIG. 1 is a perspective view of a coil pack.

FIG. 1 depicts a coil pack 20 formed from a fiber 22. The fiber 22 is typically an electrically conducting metallic wire or an optical fiber cable. The coil pack 20 may be understood, in terms of the manner in which it is formed and in which the dispensing of the fiber 22 is accomplished, as a series of flat spiral coils 24 of the fiber 22 joined together in a face-to-face manner along an axis 26 of the coil pack 20. The coil pack 20 is typically supported at one end by a flange 28, which in turn is fixed to a support such as a launch point or the internal structure of a missile, including either a missile that flies through the air or a torpedo that travels through the water. (FIG. 1 shows the flange 28 as a flat plate, but it can be a housing as will be discussed in relation to FIG. 7, or other operable form.) The ends of the fiber 22 are connected to control apparatus in the missile and at the launch point. After the missile is launched, the fiber 22 is dispensed from the coil pack 20 by the spiral unwinding of the fiber from the outside toward the inside of one of the spiral coils 24 until that spiral coil is fully unwound, at which point the unwinding sequence moves to the next spiral coil and repeats. In view of this mode of dispensing, the coil pack 20 is formed in much the same manner, but with the steps performed in reverse order.

Figure 2:
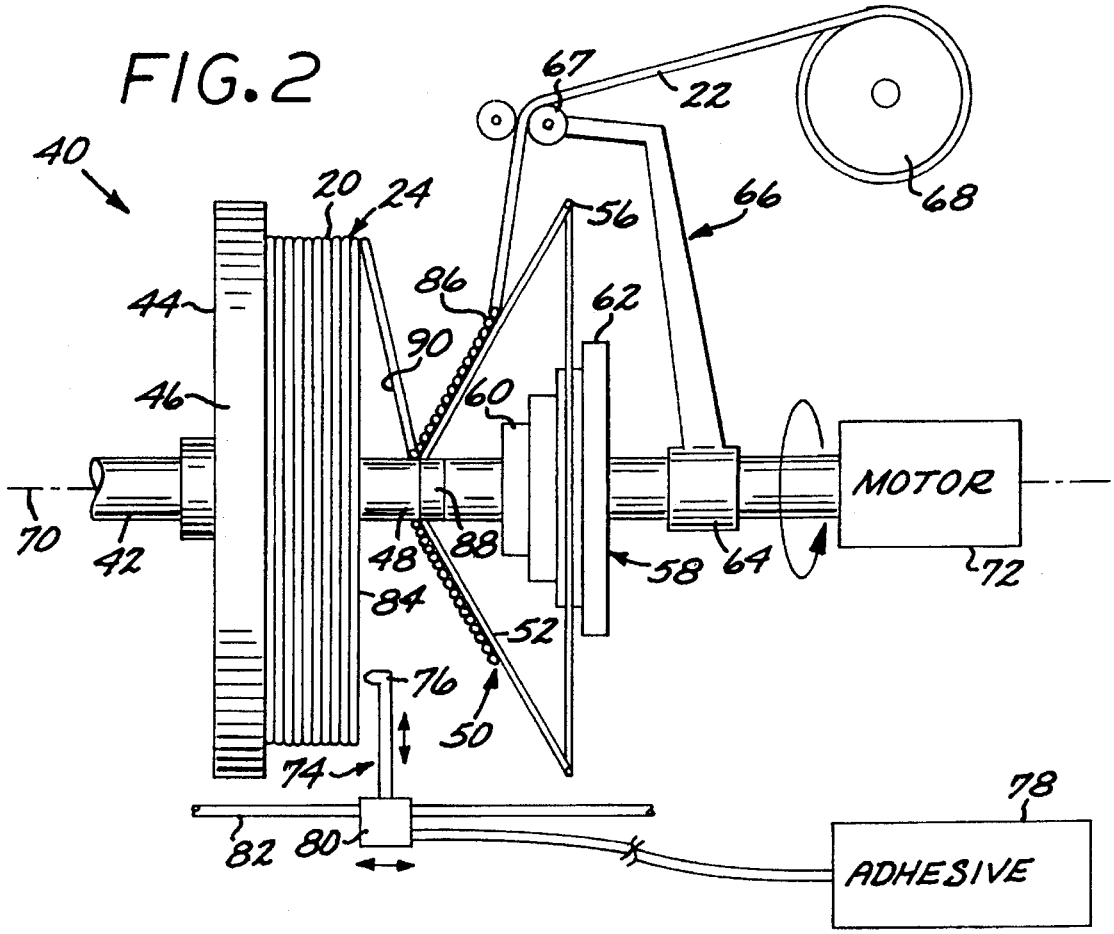
FIG. 2 is a schematic side elevational view of an apparatus for winding a coil pack in a first-position configuration.
Figure 3:
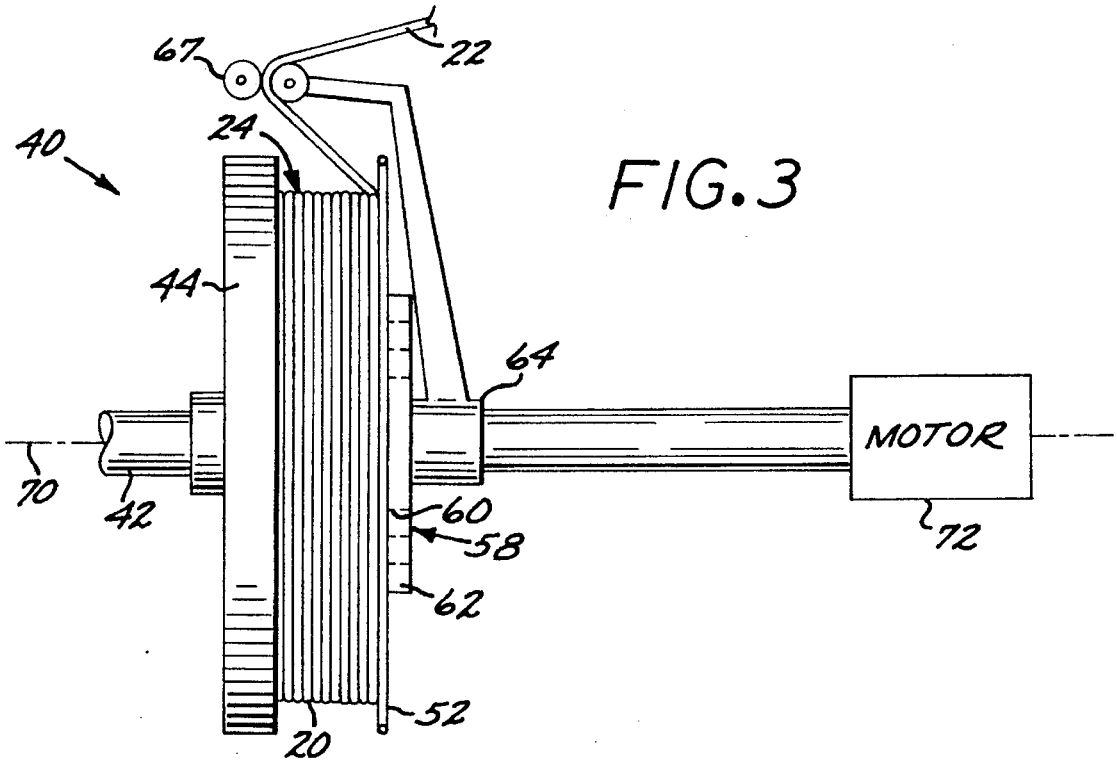
FIG. 3 is a schematic side elevational view of the apparatus of FIG. 2, with the apparatus in a second-position configuration.

FIGS. 2 and 3 illustrate a coil pack winding apparatus 40 which is operable to prepare a coil pack such as the coil pack 20. The apparatus 40 includes a central shaft 42 which supports the other components and also can be turned to provide relative circumferential motion in the manner to be discussed subsequently. A first flange 44 is supported at a first location 46 on the shaft 42. The flange 44 is preferably selected as the flange 28, but it may be a separate fabrication flange upon which the coil pack is fabricated and later transferred to the flange 28. The flange 44 is illustrated as planar and extending from the shaft 42 at a right angle. The flange could also be of another shape, such as slightly conical.

The shaft 42 also has an oppositely disposed second location 48, spaced apart along the length of the shaft 42 from the first location 46. A coil support base 50 is positioned along the shaft 42 in the neighborhood of the second location 48. The coil support base 50 includes a flexible flange 52 supported on the shaft 42 at the second location 48. The coil support base 50 includes an inner edge 54 disposed adjacent to the central shaft 42 and an outer edge 56 remote from the central shaft 42.

The flexible flange 52 has a shape that is selectively controllable. The flexible flange 52 is selectively controllable to a first shape at a first position, illustrated in FIG. 2, wherein the distance from the inner edge 54 to the first flange 44 is less than the distance from the outer edge 56 to the first flange 44. The flexible flange 52 is selectively controllable to a second shape at a second position, illustrated in FIG. 3, wherein the distance from the inner edge 54 to the first flange 44 is substantially the same as the distance from the outer edge 56 to the first flange 44. To accomplish this shape change between the first shape and the second change, the flexible flange is preferably made of a thin substrate such as a metal or composite sheet with a thin elastomeric material, such as a piece of rubber, bonded to the substrate. The elastomeric material is preferably slightly tacky to the touch, so that the fiber wound against its surface is gently held in place.

The coil support base 50 further includes a mechanism to cause the flexible flange 52 to move between the first shape and the second shape. Any operable mechanism can be used, and the preferred approach utilizes a set of nestable cylinders 58 supported on the shaft 42 and positioned such that the flexible flange 52 is between the first flange 44 and the set of nestable cylinders 58. The set of nestable cylinders includes an inner cylinder 60 having an inner cylinder outer diameter and an outer cylinder 62 having an outer cylinder outer diameter greater than the inner cylinder outer diameter. The set of nestable cylinders 58 is movable between a first arrangement, shown in FIG. 2, wherein a first-arrangement distance of the inner cylinder 60 from the first flange 44 is less than a first-arrangement distance of the outer cylinder 62 from the first flange 44, and a second arrangement, shown in FIG. 4, wherein a second-arrangement distance of the inner cylinder 60 from the first flange 44 is substantially the same as a second-arrangement distance of the outer cylinder 62 from the first flange 44.

The mechanism of the coil support base further includes a cylinder drive 64 engaged to the set of radially nestable cylinders 58. The cylinder drive 64 has a first position wherein the set of nestable cylinders 58 is in its first arrangement and a second position wherein the set of nestable cylinders 58 is in its second arrangement. The cylinder drive 64 preferably includes a drive motor that is supported on and is driven axially along the shaft 42, as seen by comparing the position of the cylinder drive 64 in FIGS. 2 and 3. The cylinder drive 64 controllably moves to the first position, shown in FIG. 2, and draws the set of nestable cylinders 58 into their un-nested position through a linkage in the set of nestable cylinders 58. At a later time, the cylinder drive 64 controllably moves to the second position, shown in FIG. 3, and forces the set of nestable cylinders 58 into their nested position.

The coil pack winding apparatus 40 includes a fiber winding head 66 used in forming spiral coils of fiber 22. In the illustrated embodiment, the fiber winding head 66 is supported on the cylinder drive 64, so that the fiber winding head 66 can move axially with the cylinder drive 64. The fiber winding head 66 has a fiber guide 67 that guides the fiber 22, provided from a fiber source 68, into contact with the flexible flange 52 during the preparation of the coil pack. The shaft 42 and the fiber winding head 66 rotate circumferentially relative to each other about an axis 70. In FIG. 2, a motor 72 drives the shaft 42 to rotate about the axis 70, with the cylinder drive 64 and fiber winding head 66 being rotationally stationary (but movable axially). Equivalently, the shaft 22 could be stationary and the fiber winding head 66 could rotate.

An adhesive can be applied to the coil pack or to the fiber coil by an adhesive applicator 74. The adhesive applicator 74 is positioned laterally adjacent to the shaft 42, with an adhesive applicator head 76 supplied with a flowable adhesive from an adhesive source 78. The adhesive is typically a silicone polymeric adhesive. Adhesives are widely used and well known in the art in the fabrication of fiber dispensers to hold the fiber in place in the pack. The adhesive is selected to provide a sufficient adhesive force but to be readily parted as the fiber is dispensed from the fiber pack. The adhesive applicator head 76 is carried on a support 80 that controllably moves the adhesive applicator head 76 radially with respect to the shaft 42, so that the adhesive applicator head 76 is movable between a first position adjacent to the central shaft 42 and a second position remote from the central shaft 42 and intermediate positions, and axially along the shaft 42 (parallel to the axis 70) on a track 82. The support 80, operating in conjunction with the movement produced by the motor 72, thus permits application of adhesive to an entire radially and circumferentially extending exposed surface 84 of the coil pack 20 as it is being fabricated.

Figure 5:
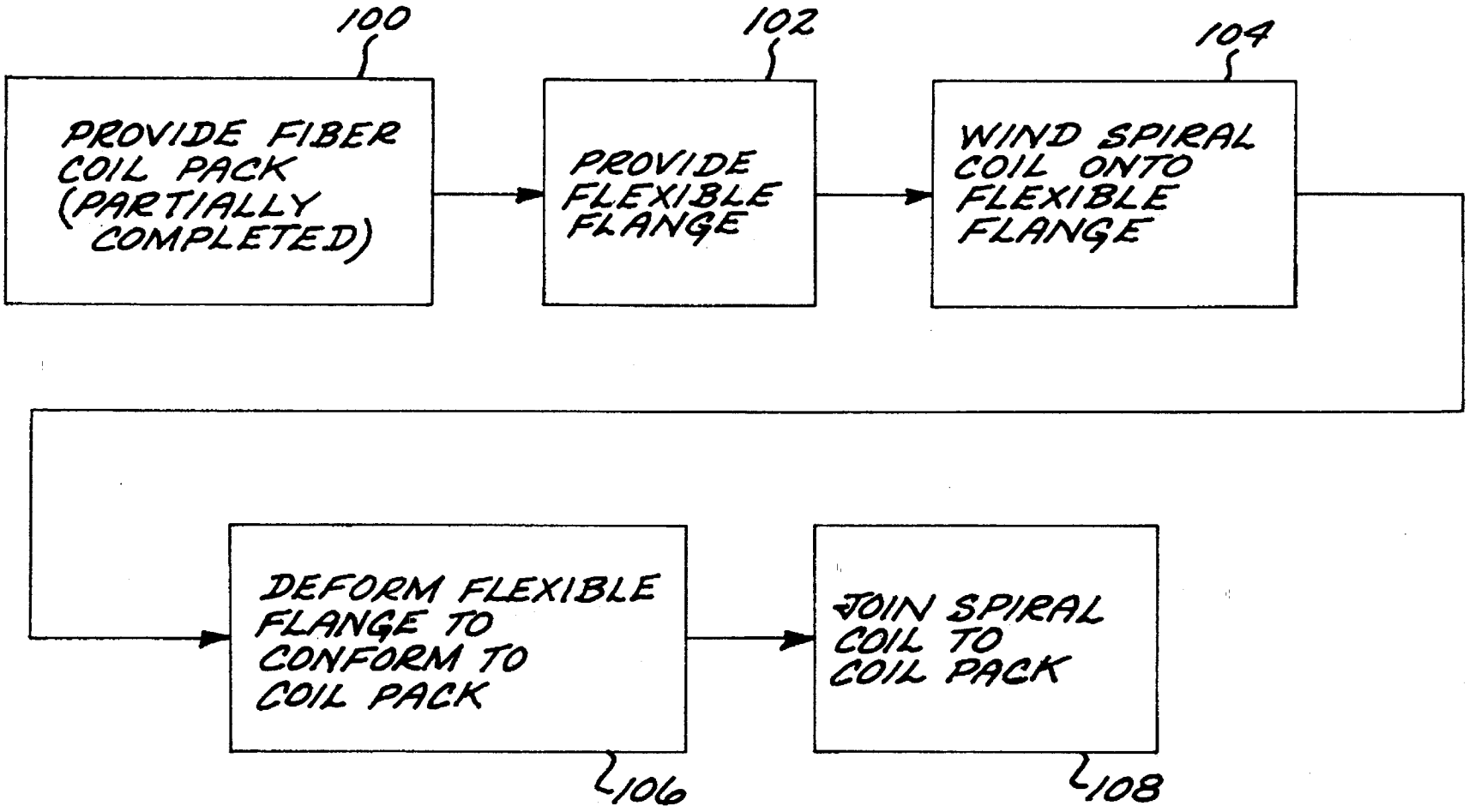
FIG. 5 is a block diagram of a method for practicing the invention.

FIG. 5 illustrates a method for winding the coil pack. The partially completed fiber coil pack is provided, numeral 100, at the state shown in FIGS. 2 and 3. At the beginning of the winding procedure, step 100 is omitted and the first spiral coil is placed against the first flange 44 or a base layer initially established on the first flange 44. The flexible flange 52 is provided, numeral 102, in the first position illustrated in FIG. 2. A spiral coil 86 is wound onto the flexible flange 52, numeral 104, by feeding fiber 22 through the fiber winding head 66 as the motor 72 rotates the shaft 22, and the flexible flange 52 supported thereon, about the axis 70. The spiral coil 86 is built up beginning with the smallest diameter turns near the shaft 52 and proceeding outwardly. The backwardly angled position of the flexible flange and its slightly tacky surface aid in forming the spiral coil and holding it in place as it is wound.

After the complete spiral coil 86 is wound, a thin layer of adhesive is applied to the exposed surface 84 by the adhesive applicator 74. Equivalently for joining purposes, the adhesive can be applied to the spiral coil 86 while it is in the position illustrated in FIG. 2. The former is preferred to avoid too great a buildup of adhesive on the flexible flange 52 as succeeding spiral coils are wound. In this embodiment the application of adhesive is described as occurring just before step 106. However, it could occur earlier in the processing, as for example before or during step 104, depending upon the drying characteristics of the selected adhesive.

The cylinder drive 64 is operated to move the set of nestable cylinders 58 to its second position illustrated in FIG. 3, thereby deforming the flexible flange 52 to its second position, numeral 106. The spiral coil 86, formed as a conical coil against the flexible flange 52, is similarly deformed to a planar or conical shape (depending upon the shape of the flange 44) as the flexible flange deforms. The spiral coil 86 thus conforms to the shape of the exposed surface 84. (Although the exposed surface 84 is illustrated as planar due to the use of a planar first flange 44, it could be nonplanar and the spiral coil 86 would conform to it due to the structure of the flexible flange.) Simultaneously, the coil support base 50 is moved toward the first flange 44 by the axial movement of the cylinder drive 64.

The spiral coil 86, now in a planar shape, is pressed against the exposed surface 84 of the coil pack 20, adding one additional spiral coil (layer) to the coil pack 20. This additional spiral coil is joined to the coil pack, numeral 108, by the adhesive applied to the coil pack or the spiral coil.

The cylinder drive 64 next reciprocates back to the first position shown in FIG. 2. The flexible flange 52 is thereby moved back to its first position as well. The fiber winding head 66 is operated to drape the fiber 22 inwardly to a position near the inner edge 54 of the flexible flange 52 as a transition region 90 that is trapped between succeeding spiral coils, and the next spiral coil is wound to begin the next cycle. Care is taken so that the transition region 90 of the fiber 22 from the outer edge of the spiral coil just wound to the inner edge of the spiral coil to be next wound occurs at a different circumferential location between succeeding pairs of spiral coils. This circumferential displacing of the transition region 90 prevents the development of an internal bulge that would be externally visible in the coil pack 20 and could lead to irregular payout of the fiber. These steps are repeated as many times as necessary to develop a coil pack of the desired length of fiber 22.

Figure 4:
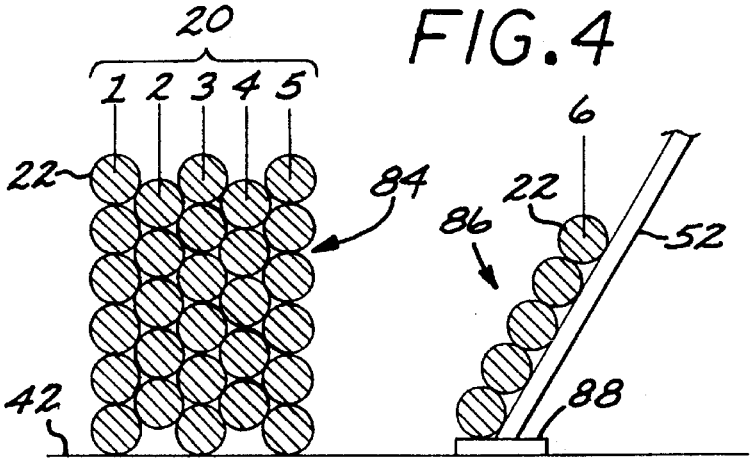
FIG. 4 is a schematic depiction of the coil pack wound on the apparatus of FIGS. 2–3, illustrating the technique for staggering the wound coils.

The spiral coil 86 may be joined to the exposed surface 84 of the coil pack 20 in any manner. FIG. 4 is a schematic depiction of the coil pack 20 and a preferred method of joining, together with the structural element of the apparatus 40 used to accomplish that preferred method of joining. It is preferred that the spiral coils be joined to the coil pack in a radially staggered fashion, so that the turns of each succeeding spiral coil are positioned between the turns of the preceding spiral coil. In FIG. 4, the turns of spiral coil 2 are positioned between the turns of spiral coil 1, the turns of spiral coil 3 are positioned between the turns of spiral coil 2, etc. This arrangement produces the most compact and strongest coil pack.

To accomplish this staggered configuration in the coil pack 20 in a controllable manner, a retractable sleeve 88 overlies the shaft 42. The retractable sleeve 88 has a thickness of about ½ the thickness of the fiber 22. Alternating spiral coils 86 are started against the retractable sleeve 88. That is, spiral coil 1 of FIG. 4 is not started against the retractable sleeve 88—the sleeve 88 is retracted out of the way when the spiral coil 1 is started. When spiral coil 2 is started, the retractable sleeve 88 is in its extended or operable position shown in relation to spiral coil 6 of FIG. 4. By starting the spiral coil 2 against the retractable sleeve 88, the innermost turn of the spiral coil is spaced upwardly by about ½ of the diameter of the fiber 22. When the spiral coil 2 is then pressed against the exposed surface 84 in the deforming step 106 and the joining step 108, the turns of the spiral coil 2 are aligned with the slight recess between the turns of the preceding spiral coil 1. This alternating use of the retractable sleeve 88 produces the preferred staggered-coil arrangement illustrated in FIG. 4.

Figure 6:
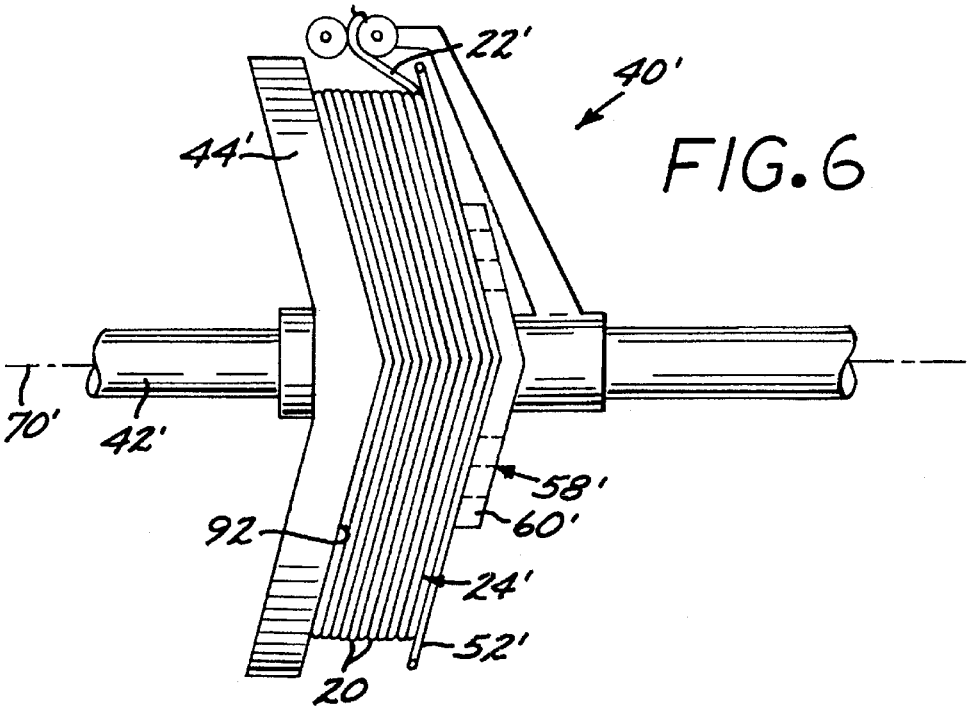
FIG. 6 is a schematic side elevational view of another embodiment of the coil-winding apparatus.

As previously discussed, the first flange 44 need not be planar, but may be generally conical (i.e., convex). FIG. 6 schematically depicts another form of the coil pack winding apparatus, indicated by numeral 40', at a stage of coil pack fabrication comparable to that illustrated in FIG. 3 for the apparatus 40. The apparatus 40' utilizes the same components as the apparatus 40. Such identical elements have been assigned the same numbers as in FIGS. 2–4, except that prime (') notation has been appended, and the prior description is incorporated herein. In FIG. 6, the first flange 44' has a face 92 adjacent to the coil pack 20' which is convex, and more specifically is formed as a conical surface. Each spiral coil 24' is therefore of the conical shape defined by the face 92. Each conical-shape spiral coil 24' is readily produced using essentially the same approach as that described for the apparatus 40, by allowing the nestable cylinders 58' to flex the flexible flange 52' past the plane lying perpendicular to the shaft 42' (which was the limit of travel in the approach of the apparatus 40) to lie parallel to the face 92.

Figure 7:
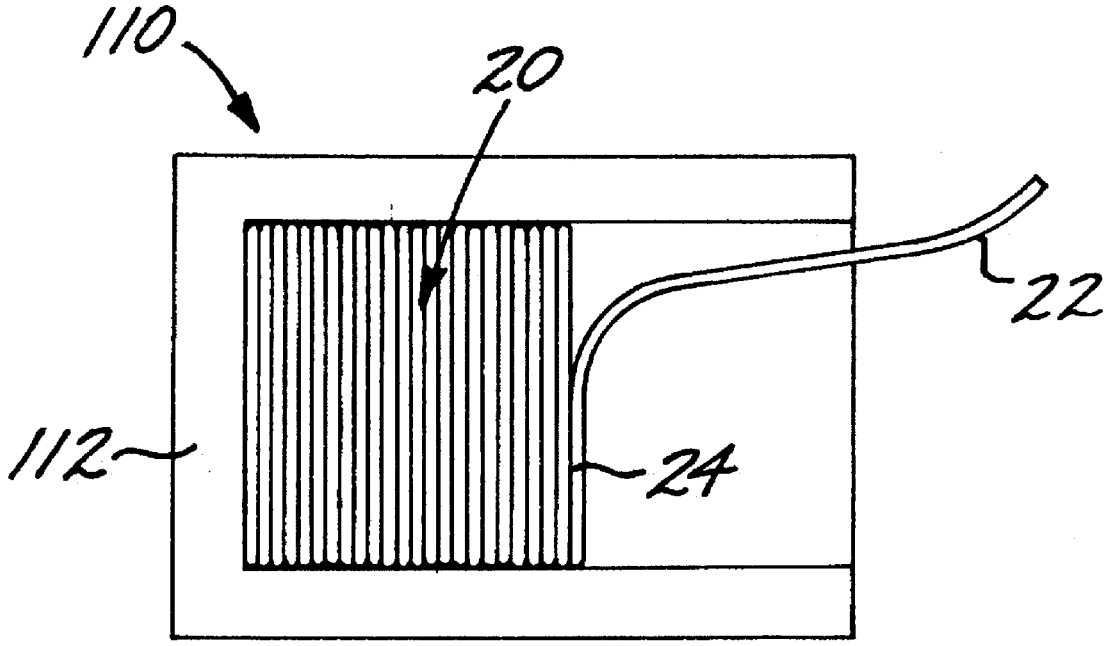
FIG. 7 is a schematic sectional view of a coil assembly having a housing that contains the coil pack.

The coil pack 20 wound onto the flange 28 may be too fragile for some applications, because there is no supporting mandrel for the coil pack. FIG. 7 depicts another form of the flange structure and coil pack as a coil assembly 110 that is structurally more robust. After the coil pack 20 is wound on the first flange 44, a curable plastic potting compound is cast around the exterior of the coil pack 20 to form a housing 112 in which the coil pack 20 resides. The housing protects the coil pack 20 from damage and against delamination of the spiral coils 24 from the coil pack 20 during storage and flight, prior to payout. When the fiber 22 is paid out by the unwinding of the succession of spiral coils 24, the payout is from the interior of the potting structure 112. The coil assembly 110 is illustrated as rectangular, but it can be any shape to conform to the external shape of the coil pack or even the internal shape of the volume provided for the coil assembly in the missile.

The coil pack winding approach of the invention provides an automated technique for fabricating coil packs that minimizes the introduction of winding defects in the coil pack, yet is operable at a sufficiently high speed that the coil pack is produced economically. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. Coil pack winding apparatus, comprising:

a central shaft having a first location and an oppositely disposed second location;

a first flange overlying the central shaft at a location adjacent to the first location of the central shaft;

a coil support base, comprising a flexible flange having an inner edge adjacent to the central shaft and an outer edge remote from the central shaft, the flexible flange having a shape that is variable between a first position wherein a first-position distance of the inner edge of the flexible flange from the first flange is less than a first-position distance of the outer edge of the flexible flange from the first flange, and a second position wherein a second-position distance of the inner edge of the flexible flange from the first flange is substantially the same as a second-position distance of the outer edge of the flexible flange from the first flange, and means for flexing the flexible flange between the first position and the second position;

a fiber winding head including a fiber guide; and means for moving the fiber winding head circumferentially relative to the central shaft.

2. The coil pack winding apparatus of claim 1, wherein the central shaft is stationary, and wherein the means for moving comprises means for rotating the fiber winding head about the stationary central shaft.

3. The coil pack winding apparatus of claim 1, wherein the fiber winding head is stationary, and wherein the means for moving comprises means for rotating the central shaft relative to the stationary fiber winding head.

4. The coil pack winding apparatus of claim 1, wherein the flexible flange is made of an elastomer.

5. The coil pack winding apparatus of claim 1, wherein the means for flexing comprises a set of nestable cylinders supported on the central shaft and positioned such that the flexible flange is between the first flange and the set of nestable cylinders, the set of nestable cylinders including an inner cylinder having an inner cylinder outer diameter and an outer cylinder having an outer cylinder outer diameter greater than the inner cylinder outer diameter, the set of nestable cylinders being movable between a first arrangement wherein a first-arrangement distance of the inner cylinder from the first flange is less than a first-arrangement distance of the outer cylinder from the first flange, and a second arrangement wherein a second-arrangement distance of the inner cylinder from the first flange is substantially the same as a second-arrangement distance of the outer cylinder from the first flange.

6. The coil pack winding apparatus of claim 5, wherein the means for flexing further comprises a cylinder drive engaged to the set of radially nestable cylinders, the cylinder drive having a first position wherein the set of nestable cylinders is in its first arrangement and a second position wherein the set of nestable cylinders is in its second arrangement.

7. The coil pack winding apparatus of claim 1, further including means for axially displacing the coil support base axially along the central shaft.

8. The coil pack winding apparatus of claim 1, further including an adhesive applicator having an adhesive applicator head movable between a first position adjacent to the central shaft and a second position remote from the central shaft.

9. The coil pack winding apparatus of claim 8, further including means for axially displacing the adhesive applicator head along the central shaft.

10. The coil pack winding apparatus of claim 1, further including a coil of a fiber disposed between the first flange and the flexible flange, the coil being in contact with the flexible flange.

11. The coil pack winding apparatus of claim 1, further including a coil pack comprising a plurality of coils of a fiber disposed between the first flange and the flexible flange, the coil pack being in contact with the first flange.

12. The coil pack winding apparatus of claim 1, further including a source of an optical fiber disposed to deliver the optical fiber to the fiber winding head.

13. The coil pack winding apparatus of claim 1, further including a retractable sleeve positioned between the central shaft and the inner edge of the flexible flange.

14. Coil pack winding apparatus, comprising:

a central shaft having a first location and an oppositely disposed second location;

a first flange overlying the central shaft at a location adjacent to the first location of the central shaft;

a coil support base, comprising a flexible flange having an inner edge adjacent to the central shaft and an outer edge remote from the central shaft, the flexible flange having a shape that is variable between a first position wherein a first-position distance of the inner edge of the flexible flange from the first flange is less than a first-position distance of the outer edge of the flexible flange from the first flange, and a second position wherein a second-position distance of the inner edge of the flexible flange from the first flange is substantially the same as a second-position distance of the outer edge of the flexible flange from the first flange, a set of nestable cylinders supported on the central shaft and positioned such that the flexible flange is between the first flange and the set of nestable cylinders, the set of nestable cylinders including an inner cylinder having an inner cylinder outer diameter and an outer cylinder having an outer cylinder outer diameter greater than the inner cylinder outer diameter, the set of nestable cylinders being movable between a first arrangement wherein a first-arrangement distance of the inner cylinder from the first flange is less than a first-arrangement distance of the outer cylinder from the first flange, and a second arrangement wherein a second-arrangement distance of the inner cylinder from the first flange is substantially the same as a second-arrangement distance of the outer cylinder from the first flange;

a cylinder drive engaged to the set of radially nestable cylinders, the cylinder drive having a first position wherein the set of nestable cylinders is in its first arrangement and a second position wherein the set of nestable cylinders is in its second arrangement;

a fiber winding head including a fiber guide; and a circumferential drive engaged to one of the central shaft and the fiber guide.

15. The coil pack winding apparatus of claim 14, wherein the flexible flange is made of an elastomer.

16. The coil pack winding apparatus of claim 14, further including a coil support drive engaged to the coil support base and operable to move the coil support base axially along the central shaft.

17. The coil pack winding apparatus of claim 14, further including an adhesive applicator having an adhesive applicator head movable between a first position adjacent to the central shaft and a second position remote from the central shaft.

18. The coil pack winding apparatus of claim 14, further including a coil pack comprising a plurality of coils of a fiber disposed between the first flange and the flexible flange, the coil pack being in contact with the first flange.

19. The coil pack winding apparatus of claim 14, further including a source of an optical fiber disposed to deliver the optical fiber to the fiber winding head.

* * * * *